US006460777B2

(12) United States Patent
Float et al.

(10) Patent No.: US 6,460,777 B2
(45) Date of Patent: Oct. 8, 2002

(54) BENDABLE INSULATED DRINKING STRAW FOR DRINKING HOT AND COLD LIQUIDS

(76) Inventors: Ardele Y. Float, 2 Shire, Coto de Caza, CA (US) 92679; Kenneth W. Float, 2 Shire, Coto de Caza, CA (US) 92679

( * ) Notice: Subject to any disclaimer, the term of this patent is extended or adjusted under 35 U.S.C. 154(b) by 0 days.

(21) Appl. No.: 09/947,185

(22) Filed: Sep. 4, 2001

(65) Prior Publication Data

US 2002/0030115 A1 Mar. 14, 2002

Related U.S. Application Data

(63) Continuation-in-part of application No. 09/433,627, filed on Nov. 3, 1999, which is a continuation-in-part of application No. 09/420,480, filed on Oct. 19, 1999, now abandoned, which is a continuation-in-part of application No. 09/189,968, filed on Nov. 10, 1998.

(51) Int. Cl.[7] ..... A47G 21/18
(52) U.S. Cl. ..... 239/33
(58) Field of Search ..... 239/33; 138/112, 138/108, 149

(56) References Cited

U.S. PATENT DOCUMENTS 3,438,578 A * 4/1969 Peterson et al. ..... 239/33
3,615,595 A * 10/1971 Guttad ..... 99/171
3,729,136 A * 4/1973 Friedman ..... 239/33
4,340,175 A * 7/1982 Danek et al. ..... 239/33
4,613,474 A * 9/1986 Donati ..... 264/320
5,441,083 A * 8/1995 Korgaard ..... 138/149
5,697,786 A * 12/1997 Lange-Mickel et al. ..... 433/96
6,158,611 A * 12/2000 Cornell et al. ..... 239/33

FOREIGN PATENT DOCUMENTS

FR 1307555 * 9/1962 ..... 239/33

* cited by examiner

*Primary Examiner*—Lesley D. Morris
*Assistant Examiner*—Dinh Q. Nguyen
(74) *Attorney, Agent, or Firm*—Kenneth W. Float

(57) ABSTRACT

An bendable double-walled insulated drinking straw for use in drinking hot and cold liquids. The insulated drinking straw comprises an inner tubular member that is sealed to an outer tubular insulating member at a sealed section, and that is separated from the inner tubular member at other than the sealed section to provide an air space therebetween. A flexible joint is formed at the sealed section that allows a portion of the straw on one side of the joint to articulate with respect to a portion of the straw on the other side of the joint. The double-walled portion of the straw may be the drinking end of the straw, or the entire straw may be double-walled, except for the sealed section. In one embodiment, an air space is formed between the inner and outer members. In another embodiment, interconnections are formed between the inner and outer members, such as ribs and serpentine members. In other embodiments, insulating material is disposed between the inner and outer members. The inner and outer members may also be sealed at one or more ends.

20 Claims, 2 Drawing Sheets

BENDABLE INSULATED DRINKING STRAW FOR DRINKING HOT AND COLD LIQUIDS

CROSS REFERENCE TO RELATED APPLICATIONS

This application is a continuation-in-part application of U.S. patent application Ser. No. 09/433,627, filed Nov. 3, 1999, which is a continuation-in-part application of U.S. patent application Ser. No. 09/420,480, filed Oct. 19, 1999, now abandoned, which is a continuation-in-part application of U.S. patent application Ser. No. 09/189,968, filed Nov. 10, 1998.

BACKGROUND

The present invention relates generally to drinking straws, and more particularly, to a bendable double-walled insulated drinking straw for use in drinking hot and cold liquids.

Numerous drinking straws have been designed for use in drinking liquid beverages. There are conventional tubular drinking straws, flexible drinking straws, extendable drinking straws that are used to project into milk and orange juice containers, and straws attached to helmets and other devices.

While such conventional drinking straws are designed for drinking cold liquids, none of these devices are particularly well-suited for drinking hot liquids. In particular, coffee drinkers purchase cups of coffee which are drunk on the way to work or while walking around. The cups have lids on them with an opening or openings in them that permit the person to sip the coffee. However, it is very easy to accidentally spill the coffee when drinking from these types of cups, which results in hot coffee spilling onto clothes and skin.

Another problem is that conventional straws which could be used to drink hot beverages are not insulated. Consequently, one's fingers can be scalded or at least feel uncomfortable when drinking hot beverages through them.

The drinking straw disclosed in U.S. patent application Ser. No. 09/433,627, filed Nov. 3, 1999 provides for a unique plastic drinking straw wherein outer and inner tubular members are secured or welded together in the middle area of the straw. It would be an improvement to have a straw similar to the straw disclosed in U.S. patent application Ser. No. 09/433,627, but which is bendable so that it may be folded in any direction to about 90 degrees.

Accordingly, it is an objective of the present invention to provide for a double-walled bendable insulated drinking straw that may be used to drink liquids, and in particular, hot liquids.

SUMMARY OF THE INVENTION

To accomplish the above and other objectives, the present invention provides for a bendable double-walled insulated drinking straw that may be used to consume liquids. The present invention is particularly well-suited for use in drinking hot liquids, especially hot liquids that are normally consumed from a cup or other similar container.

The bendable insulated drinking straw comprises an inner tubular member, such as an inner tubular plastic straw, for example, and an outer tubular insulating member, such as an outer tubular plastic straw, for example, that is separated from and provides insulation for the inner tubular member. The outer tubular insulating member is attached or fused to the inner tubular member at a predetermined sealing or attachment location that is separated from respective ends of the straw. A flexible joint is formed at the sealing location that allows a portion of the straw on one side of the joint to articulate with respect to a portion of the straw on the other side of the joint.

The outer tubular insulating member may be attached to the inner tubular member by sealing or melting the two members together in the area of the sealing or attachment location. Preferably, the tubular members are sealed along a length of the straw that is on the order of from one-half inch to one inch, or so. In accordance with the present invention, the sealed portion of the straw is processed so that it has a folding section or joint located at the sealed area of the straw, corresponding to the sealing or attachment location.

To make the double walled straw bendable, a plurality of circular grooves that generally are parallel to each other are formed in the sealed section, for example. The sealed section may be made folding by processing the double-walled straw using the teachings of U.S. Pat. No. 4,613,474, issued Sep. 23, 1986, for example.

The relative cross sections of the outer tubular insulating member and the inner tubular member may be such that fluid is sipped using the inner tubular member while the outer tubular insulating member is held by the person drinking the fluid. Also, the diameter of the outer tubular insulating member is such that a persons lips are in contact with it and not the inner tubular member.

The bendable double-walled insulated drinking straw of the present invention is not limited to any particular cross section. Thus, round, elliptical, square, rectangular, triangular or other shaped tubular members may be constructed using the principles of the present invention.

The outer tubular insulating member may be formed to have a cross section that matches the cross section of the inner tubular member, although this is not absolutely required. The outer tubular insulating member may be connected to the inner tubular member by means of a plurality of ribs or a serpentine member. Other interconnection members may readily be used.

The space between the inner tubular member and the outer tubular insulating member may be air, or may be filled with or comprise an insulating material. Any suitable insulating material may be used. Typical insulating materials include elastomeric materials, such as butyl, ethylene, propylene, fluorocarbon, fluorosilicone, neoprene, nitrile, silicone and thermoplastic elastomer, polyolefin tubing, polytetrafluroethylene (PTFE), polystyrene, resin, polyurethane, sponge, cellular silicone, and foam, for example.

The bendable double-walled insulated drinking straw is particularly well suited for use in drinking hot liquids, and is inserted into a cup or container holding the hot liquid. The upper exposed portion of the straw outside the container may be bent to a suitable angle via the folding section of the straw, and the outer tubular insulating member may be grasped while drinking the hot beverage, without the risk of burning one's fingers or one's lips. When the insulated drinking straw is used with a container of hot liquid, there is no need to tip the container to drink the liquid, which minimizes the possibility of accidental spillage. The outer tubular insulating member also minimizes heat transferred to one's fingers and lips so that scalding is minimized.

BRIEF DESCRIPTION OF THE DRAWINGS

The various features and advantages of the present invention may be more readily understood with reference to the following detailed description taken in conjunction with the accompanying drawings, wherein like reference numerals designate like structural elements, and in which.

DETAILED DESCRIPTION

Figure 1:
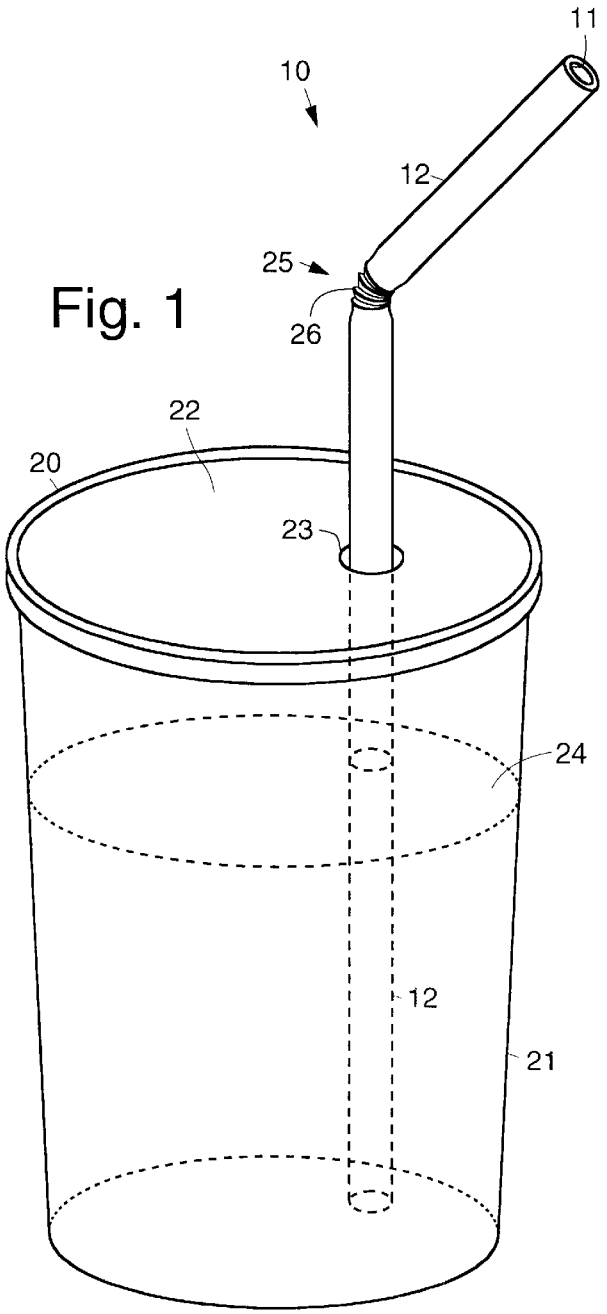
FIG. 1 illustrates an exemplary double-walled bendable insulated drinking straw in accordance with the principles of the present invention used in conjunction with a container containing a liquid.
Figure 2:
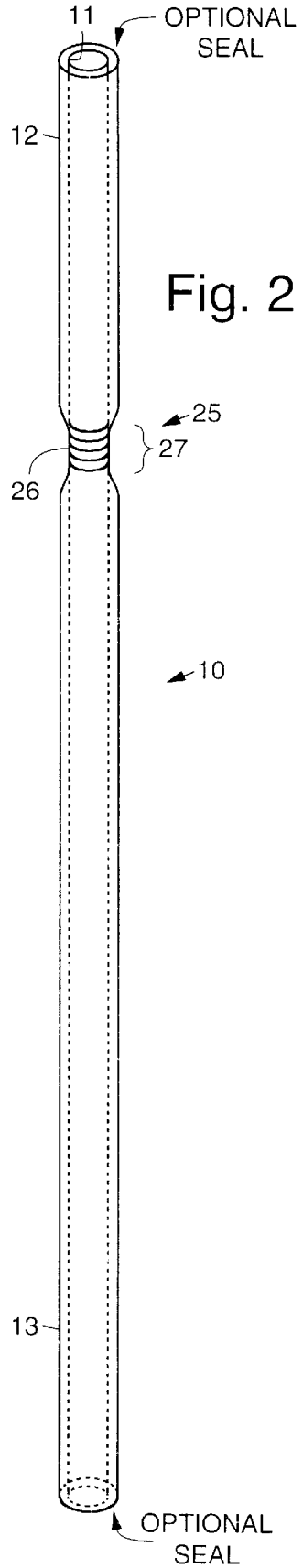
FIG. 2 is a side view of one embodiment of the double-walled bendable insulating drinking straw.
Figure 2A:
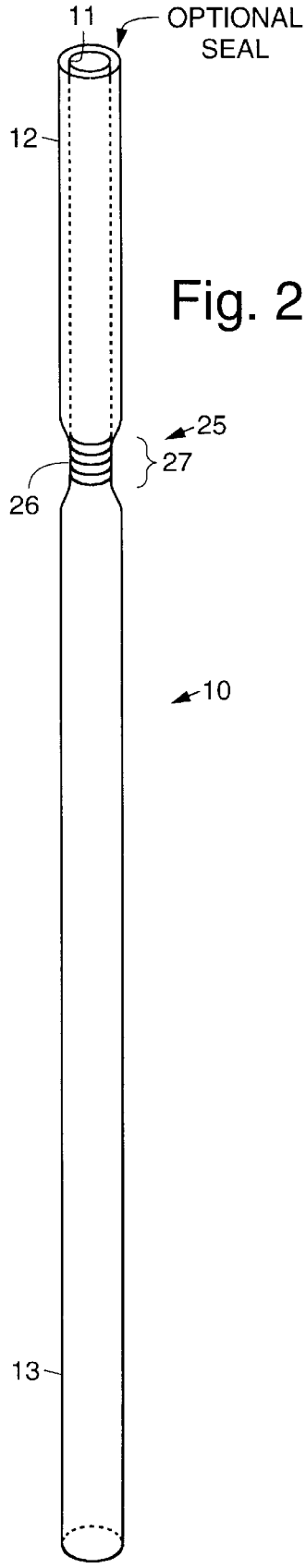
FIG. 2*a* is a side view of an alternative embodiment of the double-walled bendable insulating drinking straw.

Referring to the drawing figures, FIG. 1 illustrates an exemplary a double-walled bendable insulated drinking straw 10 in accordance with the principles of the present invention that is inserted into a container 20, such as a cup 20 for example, that contains a liquid 24 or a fluid 24. The double-walled bendable insulated drinking straw 10 shown in FIG. 1 is illustrated in a bent condition. FIG. 2 is a side view of one embodiment of the insulated drinking straw 10 in an unbent condition. FIG. 2*a* is a side view of an alternative embodiment of the double-walled bendable insulating drinking straw 10 also in an unbent condition.

The double-walled bendable insulated drinking straw 10 is well-suited for use in drinking fluids 24 or liquids 24, especially hot liquids 24 that are normally consumed from the container 20. The container 20 is shown as having a body 21 and a lid 22 with an opening 23 or hole 23 therein through which the insulated drinking straw 10 is inserted. However, it is to be understood that the insulated drinking straw 10 may be used with any container 20, with or without a lid 22, or lid 22 with a hole 23.

The double-walled insulated drinking straw 10 comprises an inner tubular member 11 or straw 11, which may be made of plastic, for example, and an outer tubular insulating member 12 or straw 12, which also may be made of plastic, for example, and which may be disposed around substantially the entire periphery of the inner tubular member 11. FIG. 2 illustrates a version of the straw 10 wherein the inner and outer members 11, 12 are substantially coextensive. However, as will be discussed below, the outer tubular insulating member 12 may only surround a portion of the inner tubular member 11. FIG. 2*a* illustrates a version of the straw 10 wherein the inner and outer members 11, 12 extend from a sealed section 27 (where the inner and outer members 11, 12 are sealed together) to the drinking end of the straw 10.

The inner tubular member 11 and the outer insulating member 12 are sealed or fused together at the sealed section 27. The inner tubular member 11 and the outer insulating member 12 may be sealed by heating the outer tubular insulating member 12 so that it is fused (sealed) to the inner tubular member 11. The sealed section 27 prevents liquid from being sucked through the space between the inner tubular member 11 and the outer tubular insulating member 12. The sealed section 27 prevents liquid from contacting the upper portion of the outer insulating member 12, which keeps it at ambient temperature so that fingers and lips of a person that contact the upper portion of the outer insulating member 12 are not exposed to excessive temperatures.

The inner tubular member 11 or straw 11 may have a tubular, square, rectangular, triangular, or hexagonal cross section, for example. Similarly, outer tubular insulating member 12 or straw 12 may have a tubular, square, rectangular, triangular, or hexagonal cross section, for example. The respective shapes of the inner tubular member 11 and outer tubular insulating member 12 need not be the same. Thus, it is to be understood that the present invention is not limited by the shape of the inner and outer tubular members 11, 12.

In the embodiment of the double-walled bendable insulated drinking straw 10 shown in FIG. 1, the inner tubular member 11 and the outer insulating member 12 are substantially coextensive. This is a preferred embodiment of the straw 10 that may be manufactured using a single plastic extrusion process, for example.

It is to be understood that the embodiments of the straw 10 described with reference to FIGS. 1 and 2 may have the inner and outer tubular members 11, 12 sealed together (see FIG. 2) at one or more of their respective ends. This may be achieved by using plastic welding or sealing processes, using a doughnut-shaped plug at the one or more ends that fit between the inner and outer tubular members 11, 12 and are sealed thereto, or by forcing a sealing material between the inner and outer tubular members 11, 12 at the one or more ends, for example.

The double-walled bendable insulated drinking straw 10 thus comprises a folding or bendable section 25 corresponding to the sealed section 27 of the straw 10 wherein the inner and outer tubular members 11, 12 are sealed together. A bendable joint 25 or folding section 25 is thus formed at the sealed section 27.

For example, to form the joint, a plurality of small circular grooves 26 that are parallel to each other are formed in the sealed section 27. The folding section 25 or joint 25 may be formed using the teachings of U.S. Pat. No. 4,613,474, issued Sep. 23, 1986, for example. The teachings of this patent are incorporated herein by reference in its entirety. However, it is to be understood that other methods of forming a folding section 25 or joint 25 of the double-walled bendable insulated drinking straw 10 may also be employed.

In accordance with the teachings of U.S. Pat. No. 4,613,474, the folding section 25 may be formed by positioning the sealed section 27 of the straw 10 on a piston pin having a section fluted by a close series of circular parallel grooves, which is inserted precisely inside the inner tubular member 11 of the straw 10. Then, two semi-circular jaws are closed that are capable of gripping the sealed section 27 of the straw 10 and having ribs parallel to each other on their internal surfaces, the profile and dimensions of which match those on the piston grip.

Alternatively, the sealed section 27 of the straw 10 may be nested in a piston pin free to turn idle, in a part of which there are small circular grooves parallel to each other. Just in this area pressing action is carried out by the rectilinear alternating and opposite movement of two bars which are orthogonal to the piston pin axis, against which they press the straw 10 having longitudinal grooves, the profile of which matches that of the grooves of the piston pin. The bars, which are maintained at an ideal temperature, form the folding section 25 or joint 25 of the straw 10 which turns idle together with the piston pin. The process is similar to rolling which is normally used for obtaining threaded bars or screw threads.

Alternatively, the sealed section 27 of the straw 10 may be supported on a grooved support plate. A rotatable piston pin having parallel circular grooves and a point for centering the straw 10 is inserted into the straw. Opposed forming bars having lengthwise grooves that are complementary to the grooves of the piston pin are moved orthogonal to the piston pin and in opposite directions while the bars are in contact with the straw 10 when positioned on the piston pin. This causes free rotation of the piston pin and formation of the folding section 25 or joint 25. The forming bars are then retracted, and the straw 10 is removed from the piston pin.

While the double-walled bendable insulated drinking straw 10 shown in FIGS. 1 and 2 has generally coextensive inner and outer tubular members 11, 12, this need not always be the case. In an alternative embodiment, shown in FIG. 2*a,* the upper portion of the double-walled bendable insulated drinking straw 10 is double walled above the sealed section 27, an the lower portion of the straw 10 is a single piece comprising the inner tubular member 11, or straw 11. Thus, in this alternative embodiment, the inner and outer tubular members 11, 12 are sealed in the sealed section 27, and the folding section 25 or joint 25 is formed. The coaxial inner and outer tubular members 11, 12 extend from the sealed section 27 or joint 25 to a drinking end of the straw 10, while the inner tubular member 11 is inserted into a container in order to drink a liquid 24.

Figure 3:
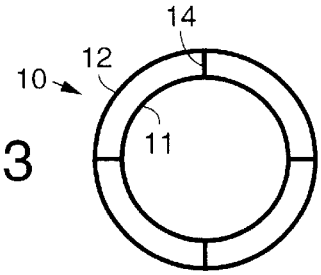
FIG. 3 is an end view of another embodiment of the insulated drinking straw.
Figure 4:
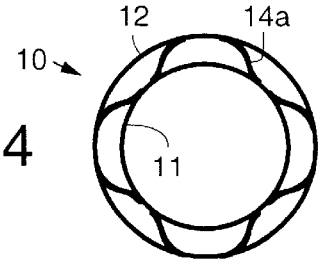
FIG. 4 is an end view of yet another embodiment of the insulated drinking straw.

The inner and outer tubular members 11, 12 may be formed to have cross sections that match each other, although this is not absolutely required. The inner and outer tubular members 11, 12 may also be connected by means of a plurality of ribs 14 extending therebetween, as is shown a second embodiment of the straw 10 shown in FIG. 3. Alternatively, the inner and outer tubular members 11, 12 may be connected by means of a serpentine member 14*a* connected therebetween. FIG. 3 is an end view of a third embodiment of the straw 10 that uses the serpentine member 14*a* to connect the inner and outer tubular members 11, 12.

Other interconnection means or members may also be used. For example, the inner tubular member 11 and outer insulating member 12 may be connected using doughnut shaped disks, for example, that are secured between the inner tubular member 11 and outer insulating member 12. The doughnut shaped disks may also be used to seal the inner tubular member 11 and outer insulating member 12 if additional insulating material disposed therebetween.

Figure 5:
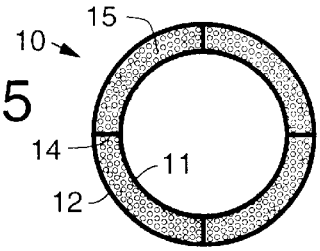
FIG. 5 is an end view of yet another embodiment of the insulated drinking straw.
Figure 6:
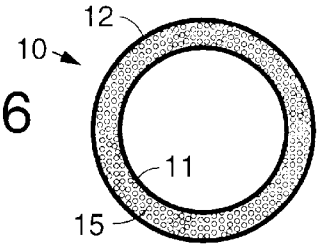
FIG. 6 is an end view of yet another embodiment of the insulated drinking straw.
Figure 7:
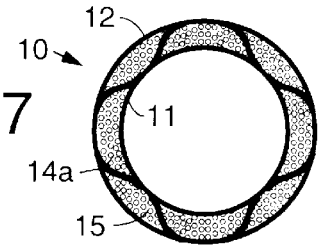
FIG. 7 is an end view of yet another embodiment of the insulated drinking straw.

The space between the inner and outer tubular members 11, 12 may be air as is shown in FIGS. 1–4, or may be filled with an insulating material 15. FIGS. 5–7 are end views of fourth, fifth and sixth embodiments of the insulated drinking straw 10 that also include insulating material 15. The straw 10 shown in FIG. 5 also includes a plurality of ribs 14, the straw 10 shown in FIG. 6 has no ribs 14 or serpentine member 14*a,* and the straw 10 shown in FIG. 7 also includes a serpentine member 14*a.* The embodiments of the double-walled bendable insulated drinking straw 10 shown in FIGS. 3 and 4, for example, including the ribs 14 or serpentine members 14*a,* may also be extruded as discussed with regard to the straw 10 described with reference to FIGS. 1 and 2.

Any insulating material 15 may be used, and in particular, those insulating materials 15 that are suitable for use in contacting the mouth. Typical insulating materials 15 include foam, butyl, ethylene, propylene, fluorocarbon, fluorosilicone, neoprene, nitrile, silicone and thermoplastic elastomer, polyolefin, polytetrafluroethylene (PTFE), polystyrene, resin, polyurethane, sponge, cellular silicone, polymer, cellulose acetate or other synthetic fiber, for example. Such insulating materials 15 are readily available or may be readily made and inserted between the insulating member 12 and the inner member 11 of the double-walled bendable insulated drinking straw 10.

The double-walled bendable insulated drinking straw 10 is made so that a person's lips are in contact with the outer tubular insulating member 12 instead of the inner tubular member 11. This double-walled bendable insulated drinking straw 10 is specifically designed to help protect a person's lips from directly contacting the inner tubular member 11 or liquid while drinking hot or cold liquids. The liquid may be drawn into the mouth with the persons lips contacting the outer insulating member 12, without the lips contacting the inner tubular member 11, which may be relatively hot. This minimizes possible burning of the lips when drinking very hot coffee, for example.

Thus, an improved bendable double-walled insulated drinking straw that may be used to drink liquids, and in particular, hot liquids has been disclosed. It is to be understood that the described embodiments are merely illustrative of some of the many specific embodiments that represent applications of the principles of the present invention. Clearly, numerous and other arrangements can be readily devised by those skilled in the art without departing from the scope of the invention.

What is claimed is:

1. A bendable double-walled insulated drinking straw comprising:

an inner tubular member;

an outer tubular insulating member disposed around at least a portion of the periphery of the inner tubular member, that is sealed to the inner tubular member at a sealed section, that is separated from the inner tubular member at other than the sealed section to provide an air space therebetween, and wherein the outer surface of the outer insulating member is disposed to contact the person's lips while drinking with the straw; and a flexible joint formed at the sealed section that allows a portion of the straw on one side of the joint, including both the inner and outer members, to articulate with respect to a portion of the straw on the other side of the joint.

2. The bendable double-walled insulated drinking straw recited in claim 1 wherein the flexible joint comprises a folding section comprising a plurality substantially parallel circular grooves.

3. The bendable double-walled insulated drinking straw recited in claim 1 wherein the inner tubular member and the outer tubular insulating member are substantially coextensive.

4. The bendable double-walled insulated drinking straw recited in claim 1 wherein the inner and outer tubular members comprise tubular plastic straws.

5. The bendable double-walled insulated drinking straw recited in claim 1 wherein the outer insulating member has a cross section that matches the cross section of the inner tubular member.

6. The bendable double-walled insulated drinking straw recited in claim 1 wherein the outer insulating member is connected to the inner tubular member by a plurality of ribs extending therebetween.

7. The bendable double-walled insulated drinking straw recited in claim 1 wherein the outer insulating member is connected to the inner tubular member by a serpentine member extending therebetween.

8. The bendable double-walled insulated drinking straw recited in claim 1 further comprising an insulating material disposed between the inner tubular member and outer insulating member.

9. The bendable double-walled insulated drinking straw recited in claim 8 wherein the insulating material consists of a material from the group including foam, butyl, ethylene, propylene, fluorocarbon, fluorosilicone, neoprene, nitrile, silicone and thermoplastic elastomer, polyolefin, polytetrafluroethylene, polystyrene, resin, polyurethane, sponge, cellular silicone, polymer, cellulose acetate, and synthetic fiber.

10. The bendable double-walled insulated drinking straw recited in claim 1 wherein the inner tubular member and the outer insulating member are sealed adjacent a drinking end of the straw.

11. A bendable double-walled insulated drinking straw comprising:

an inner tubular member;

an outer tubular insulating member disposed around the periphery of the inner tubular member, that is sealed to the inner tubular member at a sealed section, that is separated from the inner tubular member at other than the sealed section to provide an air space therebetween, and wherein the outer surface of the outer insulating member is disposed to contact the person's lips while drinking with the straw; and a flexible joint formed at the sealed section that allows a portion of the straw on one side of the joint, including both the inner and outer members, to articulate with respect to a portion of the straw on the other side of the joint.

12. The bendable double-walled insulated drinking straw recited in claim 11 wherein the flexible joint comprises a folding section comprising a plurality substantially parallel circular grooves.

13. The bendable double-walled insulated drinking straw recited in claim 11 wherein the inner tubular member and the outer tubular insulating member are substantially coextensive.

14. The bendable double-walled insulated drinking straw recited in claim 11 wherein the inner and outer tubular members comprise tubular plastic straws.

15. The bendable double-walled insulated drinking straw recited in claim 11 wherein the outer insulating member has a cross section that matches the cross section of the inner tubular member.

16. The bendable double-walled insulated drinking straw recited in claim 11 wherein the outer insulating member is connected to the inner tubular member by a plurality of ribs extending therebetween.

17. The bendable double-walled insulated drinking straw recited in claim 11 wherein the outer insulating member is connected to the inner tubular member by a serpentine member extending therebetween.

18. The bendable double-walled insulated drinking straw recited in claim 11 further comprising an insulating material disposed between the inner tubular member and outer insulating member.

19. The bendable double-walled insulated drinking straw recited in claim 18 wherein the insulating material consists of a material from the group including foam, butyl, ethylene, propylene, fluorocarbon, fluorosilicone, neoprene, nitrile, silicone and thermoplastic elastomer, polyolefin, polytetrafluroethylene, polystyrene, resin, polyurethane, sponge, cellular silicone, polymer, cellulose acetate, and synthetic fiber.

20. The bendable double-walled insulated drinking straw recited in claim 11 wherein the inner tubular member and the outer insulating member are sealed adjacent a drinking end of the straw.

* * * * *